United States Patent [19]

Limbach

[11] Patent Number: 4,665,576

[45] **Date of Patent: * May 19, 1987**

[54] SKI BOOT AND BOOT CANTING METHOD

[76] Inventor: Robert C. Limbach, 49 Bellevue, Belvedere, Calif. 94920

[ * ] Notice: The portion of the term of this patent subsequent to Feb. 4, 2003 has been disclaimed.

[21] Appl. No.: 807,272

[22] Filed: Dec. 10, 1985

Related U.S. Application Data

[63] Continuation-in-part of Ser. No. 645,507, Aug. 30, 1984, Pat. No. 4,567,617.

[51] Int. Cl.[4] ..... A43D 9/00; A43D 7/14

[52] U.S. Cl. ..... 12/142 P; 12/142 N; 36/117; 36/93

[58] Field of Search ..... 36/117, 119, 81, 43, 36/44, 71; 128/584, 585, 600, 601, 619, 622; 12/142 P, 142 R; 182/108

[56] References Cited

U.S. PATENT DOCUMENTS

| | | | |
|---|---|---|---|
| 1,039,396 | 9/1912 | Hilgert | 36/43 |
| 1,850,122 | 3/1932 | Thomas | 128/600 |
| 1,957,695 | 5/1934 | Chiappetta | 128/600 |
| 1,958,097 | 5/1934 | Shaw | 128/585 |
| 2,052,115 | 8/1936 | Shirman | 36/71 |
| 2,097,959 | 11/1937 | Whitman | 128/600 |
| 2,390,416 | 12/1945 | Bettmann | 128/585 |
| 4,069,890 | 1/1978 | Gottliebsen | 182/108 |
| 4,557,061 | 12/1985 | Graillat et al. | 36/119 |
| 4,567,617 | 2/1986 | Limbach | 12/142 P |

*Primary Examiner*—Henry S. Jaudon
*Assistant Examiner*—Steven N. Meyers
*Attorney, Agent, or Firm*—Karl A. Limbach

[57] ABSTRACT

A canting adjustment for ski boots and a method of canting in which the ski boot contains a plurality of wedge shaped removable innersoles having generally equal and opposite wedge angles to allow a wide range of canting angles.

2 Claims, 3 Drawing Figures

SKI BOOT AND BOOT CANTING METHOD

BACKGROUND OF INVENTION

This application is a Continuation-in-Part of my co-pending application Ser. No. 06/645,507 filed Aug. 30, 1984, now U.S. Pat. No. 4,567,617, relating to a method of canting ski boots.

In my related application I disclosed a method of canting ski boots in which a skier is provided with an orthotic to provide an individually corrected stance for the skier. This corrected stance is preserved in a ski boot having an outer shell and inner bladder by a two step process. In the first step the skier stands on an orthotic in the empty shell from which the bladder has been removed, and a record is made of the relation between the shell and the skier's leg (the position of the knee cap measured by a plumb bob, the axis of the shin, etc.). In the second step the skier stands on the orthotic inside the bladder of a boot with the boot assembled and closed on the skier's leg, and the boot is adjusted through a canting angle to reestablish the original relationship between the shell and leg which was recorded in the first step. The adjustment may be made by adjusting the outer shell of the boot in a variety of ways for instance by grinding the bottom surface of the boot or by manipulating a canting adjustment built into the boot.

SUMMARY OF INVENTION

In accordance with this invention I have provided an improved boot structure and method by which the canting adjustment can be made without grinding a boot which heretofore required grinding. In accordance with this invention I provide a boot with a plurality of nested innersoles in each boot with the innersoles having generally equal and opposite canting angles. The canting adjustment of an individual boot is made by removing from the boot one or more of the innersoles having canting angles of the same direction, and the canting angle of the other boot of the pair may be adjusted in a similar manner by removing innersoles or by adding to the second boot wedge shaped innersoles which were removed from the first boot, an innersole from the right boot being turned upside down for use in the left boot.

This arrangement for canting the boot is particularly advantageous with one piece boot shells in which a canting adjustment cannot be made by adjusting a hinge connection between a foot portion and a cuff portion of the boot. Such one piece boot shells are popular in less expensive boots and in rear entry boots where the boot shell is opened by a buckle at the rear instead of buckles on the top.

This arrangement for making a canting adjustment is an important improvement over the old technique of grinding the sole of the boot, because such grinding requires further adjustment of the heel and toe to comply with DIN standards and may create problems with the manufacturer's warranty if the structural body of the shell is ground.

This improved boot may be used to provide a canting adjustment without the use of orthotics, but preferably the boot is used with orthotics to adjust the canting of the boot in accordance with the method of my co-pending application. Thus, the bladder may be removed from the boot, and the skier stood on orthotics in the shell. The relative positions of the shell and the skier's leg are recorded, and the skier then stands on the orthotics in the boots with the bladders in place and the boots closed. Finally, one or more innersoles with canting angles of the same direction are removed from a boot, or innersoles from the other boot added, to reestablish the relative relation between the leg and shell noted in the first condition.

DETAILED DESCRIPTION

These and other aspects of the invention will be apparent from the following description read in conjunction with the attached drawings in which.

Figure 1:
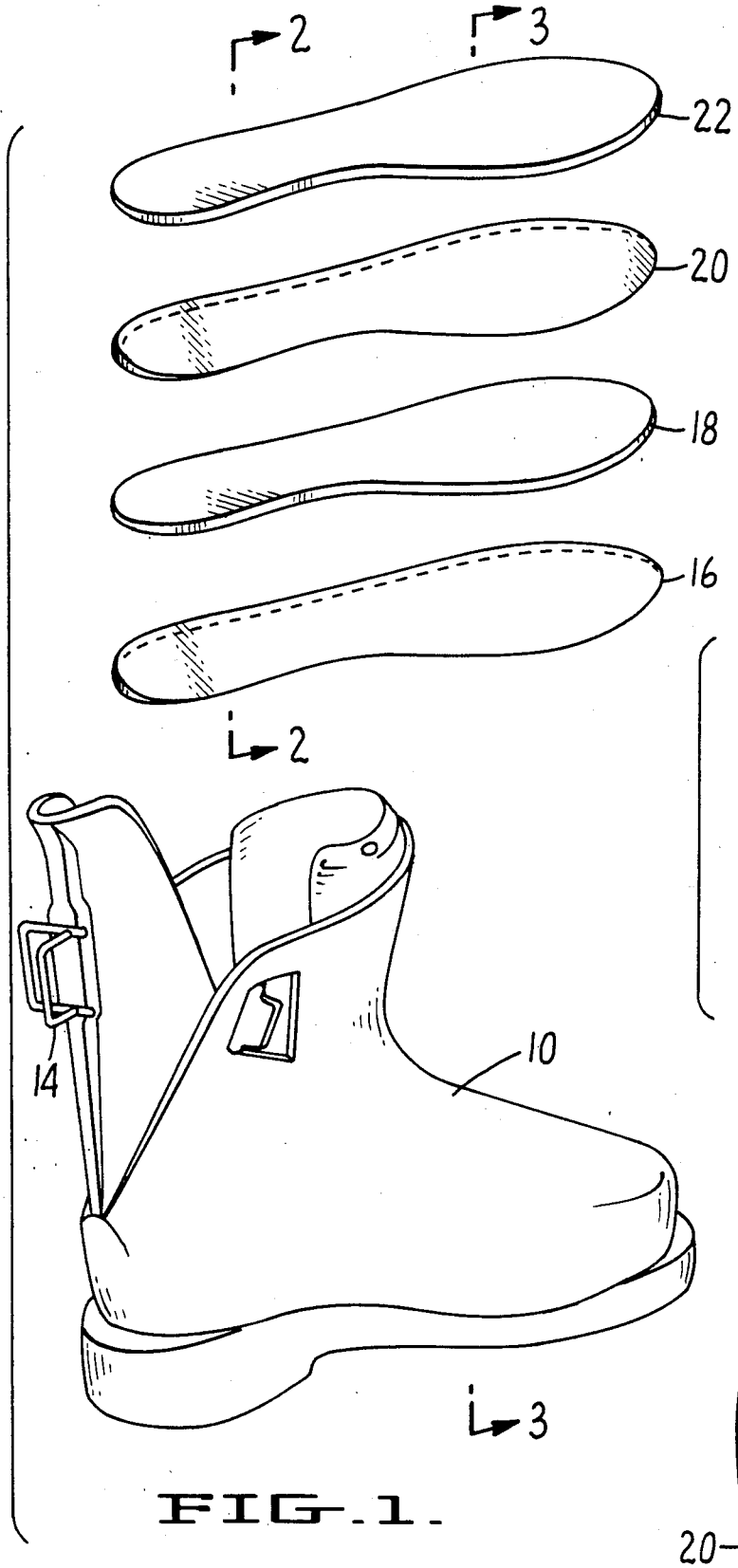
FIG. 1 is a perspective exploded view of a boot constructed in accordance with this invention.
Figure 2:
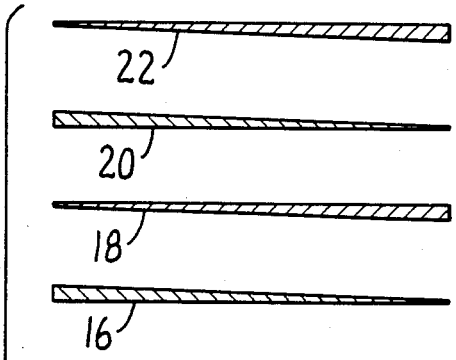
FIG. 2 is a sectional exploded view of the innersoles of the boot of FIG. 1.
Figure 3:
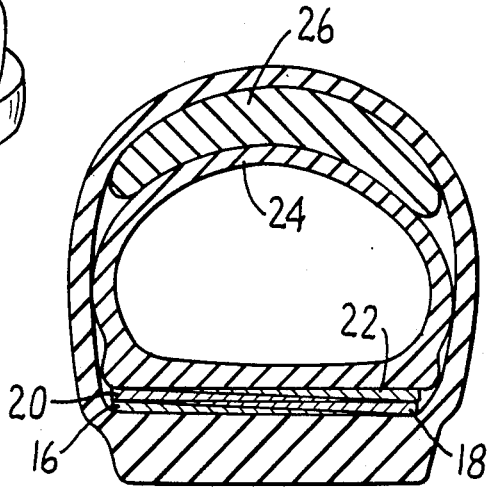
FIG. 3 is a cross sectional view of the boot of FIG. 1 with the innersoles in place.

Referring now in detail to the drawing, a one piece boot shell has a rear entry flap 12 and buckle 14, four wedge shaped innersoles 16, 18, 20, and 22, an inner bladder 24 and a pad 26 which may be made integral with the bladder 24, if desired. The innersoles 16–22 have generally equal and opposite canting angles as indicated in FIG. 2 so that the canting of the boot can be adjusted incrementally through two increments right or left by removal of one or two of the innersoles.

Thus, assuming that the innersoles are all made with a wedge angle of one degree, the boot can be canted two degrees to the right by removing the innersoles 18 and 22 while leaving the other innersoles 16 and 20 in place. Additionally, the boot can be further canted to three degrees right by removing an innersole 16 from the other boot of a pair, turning it upside down and placing it on top of the innersoles 16 and 20.

As indicated above, it is desirable to use the boot 10 in accordance with the method of my co-pending application where the boot is canted with an orthotic individually prepared for the skier. Where this is not done, it is obviously desirable to provide a generic shaped innersole with arch supports as is well known in the art.

I claim:

1. A ski boot adapted to be adjusted to different canting angles which comprises:

an outer shell adapted to engage the skier's ski, an inner bladder inside the shell adapted to embrace a skier's foot, and a plurality of wedge shaped innersoles between the bladder and the shell, with the innersoles having opposite canting angles whereby the canting angle of a boot may be adjusted by removing one or more of the innersoles with like canting direction.

2. The method of adjusting the lateral canting of a ski boot of a skier where the boot has an outer shell and an inner removable bladder, and where the skier has an orthotic adapted to correct the stance of the skier which method comprises:

providing in the ski boot a plurality of wedge shaped innersoles where each innersole has a lateral canting wedge, and where the canting angle of the innersoles are opposite;

standing the skier in a first condition on the orthotic in the outer shell of the boot with the bladder removed and recording the lateral location of the skier's knee with respect to the shell, standing the skier in a second condition on the orthotic in the ski boot while bladder is supported in the shell with a second lateral location of the skier's knee with respect to the shell, and altering the outer shell of the boot to adjust the lateral location in the second condition to be the same as the lateral location in the first condition by removing one or more of the innersoles.

* * * * *